US006649007B1

(12) United States Patent
Key

(10) Patent No.: US 6,649,007 B1
(45) Date of Patent: Nov. 18, 2003

(54) ROTATABLE LABEL FOR PHARMACEUTICAL CONTAINER AND METHOD FOR CONSTRUCTING SAME

(75) Inventor: Stephen M. Key, Modesto, CA (US)

(73) Assignee: Stephen Key Design, LLC, Modesto, CA (US)

( * ) Notice: Subject to any disclaimer, the term of this patent is extended or adjusted under 35 U.S.C. 154(b) by 0 days.

(21) Appl. No.: 10/030,321

(22) PCT Filed: Apr. 26, 2000

(86) PCT No.: PCT/US00/11496

§ 371 (c)(1),
(2), (4) Date: Oct. 26, 2001

(87) PCT Pub. No.: WO00/64676

PCT Pub. Date: Nov. 2, 2000

Related U.S. Application Data

(60) Provisional application No. 60/131,302, filed on Apr. 27, 1999.

(51) Int. Cl.[7] ..... B65C 3/08

(52) U.S. Cl. ..... 156/249; 156/215; 156/277; 156/387; 156/DIG. 9; 428/41.8

(58) Field of Search ..... 156/212, 213, 156/215, 247, 249, 384, 387, 277, 289, DIG. 9, DIG. 10, DIG. 11, DIG. 12, DIG. 13, DIG. 24; 40/306, 310, 506; 428/41.7, 41.8

(56) References Cited

U.S. PATENT DOCUMENTS

| | | | | | |
|---|---|---|---|---|---|
| 4,312,523 | A | * | 1/1982 | Haines | 40/630 |
| 4,732,411 | A | * | 3/1988 | Siegel | 283/75 |
| 4,918,604 | A | * | 4/1990 | Baum | 221/5 |
| 5,342,093 | A | * | 8/1994 | Weernink | 283/81 |
| 5,809,674 | A | * | 9/1998 | Key | 40/306 |
| 5,883,370 | A | * | 3/1999 | Walker et al. | 235/375 |
| 5,884,421 | A | * | 3/1999 | Key | 40/306 |
| 5,953,170 | A | * | 9/1999 | Glancy | 359/896 |
| 6,086,697 | A | * | 7/2000 | Key | 156/215 |
| 6,129,802 | A | * | 10/2000 | Key | 156/229 |
| 6,212,803 | B1 | * | 4/2001 | Key | 40/324 |
| 6,237,269 | B1 | * | 5/2001 | Key | 40/638 |
| 6,360,462 | B1 | * | 3/2002 | Mengel | 40/310 |
| 6,385,878 | B1 | * | 5/2002 | Key | 40/306 |
| 6,402,872 | B1 | * | 6/2002 | Key | 156/215 |

* cited by examiner

*Primary Examiner*—Curtis Mayes
(74) *Attorney, Agent, or Firm*—Carr & Ferrell LLP

(57) ABSTRACT

A rotatable label system includes a pharmaceutical container and a label arranged about the pharmaceutical container. The label has an inner label portion affixed to the pharmaceutical container and an outer label portion rotatable positioned about the inner label portion. At least one window or transparent section is provided on the outer label portion. Generic and custom imprinted indicia is disposed on the inner and outer label portions. By rotating the outer label portion relative to the inner label portion and the container, written indicia imprinted on the inner label portion is viewable through the window or transparent section.

20 Claims, 14 Drawing Sheets

ROTATABLE LABEL FOR PHARMACEUTICAL CONTAINER AND METHOD FOR CONSTRUCTING SAME

CROSS-REFERENCE TO RELATED APPLICATIONS

The present application claims the benefit of U.S. Provisional Patent Application No. 60/131,302 filed Apr. 27, 1999 entitled "Rotatable Label for Pharmaceutical Container."

The present application is related to and incorporates by reference the following patents and patent applications: U.S. Pat. No. 5,809,674 issued Sep. 22, 1998 for an invention entitled "Apparatus and Method for Increasing an Effective Information Carrying Surface Area on a Container"; U.S. Pat. No. 5,884,421 issued Mar. 23, 1999 entitled "Apparatus and Method for Constructing a Rotatable Label Device"; U.S. patent application Ser. No. 09/126,010 filed on Jul. 29, 1998 entitled "Rotating Label System and Method" now U.S. Pat. No. 6,086,697; U.S. patent application Ser. No. 09/187,299 filed Nov. 5, 1998 entitled "Rotatable Label System and Method for Constructing the Same" now U.S. Pat. No. 6,129,802; and U.S. patent application Ser. No. 09/247,245 filed Feb. 9, 1999 entitled "Rotatable Label System Including Tamper-Evident Feature and Method for Constructing Same, now U.S. Pat. No. 6,385,878."

BACKGROUND OF THE INVENTION

1. Field of the Invention

The present invention relates generally to labels and more particularly to a rotatable label for pharmaceutical containers.

2. Description of the Background Art

Many pill-formed products, such as vitamins and medications, are packaged in pharmaceutical containers. It is usually desirable to display information in the form of written indicia arranged on the exterior surface of such containers to inform consumers as to the nature and use of the associated products. This information may include directions for use, warnings, dosage amounts, and ingredients. Such information is typically printed on a label affixed to the pharmaceutical container.

A problem associated with conventional pharmaceutical labels is that typically insufficient area is available to accommodate all of the information which a pharmacist and drug manufacturer desires to provide to the consumer. In order to accommodate all of the desired information, the pharmacist or drug manufacturer may reduce font size of the indicia or space the indicia closer together. However, the reduction of text size may render some or all of the information illegible to the consumer, especially elderly consumers. Furthermore, consumers may tend to ignore information presented in "fine print."

To provide additional space for the presentation of information, it has been proposed that a rotatable outer label be positioned about a pharmaceutical container having an inner label with indicia imprinted thereon. The outer label typically has a transparent section or window, which when rotated relative to the container, allows for viewing of indicia on the inner label through the transparent section or window. This construction permits information display on both the inner and outer labels, thus increasing the display area.

Despite the advantage of having a rotatable outer label on a pharmaceutical container, it has been impractical to employ rotatable outer labels due to the complexity of printing and applying a custom imprinted rotatable label to a pharmaceutical container. Conventionally, a label is attached to a container with an adhesive applied to the back of the label. However, this manner of application yields a label that is fixed and not rotatable relative to the container. Consequently, there is a need for a system and method by which a rotatable label may be disposed about a pharmaceutical container.

SUMMARY OF THE INVENTION

The present invention overcomes or substantially alleviates problems associated with custom information display on a conventional pharmaceutical container. In general, the present invention provides a pharmaceutical container having an inner label portion with written indicia disposed thereon and a rotatable outer label portion disposed about the inner label portion. The outer label portion also has written indicia imprinted thereon. Much of this written indicia is custom imprinted by the pharmacist at the time of pharmaceutical purchase.

The rotatable outer label portion may include at least one transparent section or window which, when rotated relative to the pharmaceutical container about a central vertical axis thereof, allows selective viewing of indicia imprinted on the inner label portion affixed to the container. Because indicia may be disposed both on the inner and rotatable outer label portions, the drug manufacturer or pharmacist may advantageously provide a substantially increased amount of information to the consumer.

The present invention also discloses various methods of constructing a rotatable label system on a pharmaceutical container. According to one embodiment, the label consists of a separate inner label portion and outer label portion. After custom patient information is imprinted on the two separate label portions, the inner label portion is affixed to the container. Then, the outer label portion is independently placed over the inner label portion.

An alternative method of constructing a rotatable label system on a pharmaceutical container utilizes one label with an inner label portion and an outer label portion connected along a perforation line. After the inner label portion is affixed to the container, the connected outer label portion continuously wraps around the inner label portion and adheres to a leading edge of the outer label portion. After the outer label portion is detached from the inner label portion along the perforation line, the outer label portion is rotatable about the container.

Accordingly, the present invention provides a rotatable label system on a pharmaceutical container which permits indicia printed on an inner label portion to be viewed through a transparent section or window of an outer rotatable label portion having further indicia disposed thereon. Other advantages and features of the present invention will be apparent from the drawings and detailed description as set forth below.

DETAILED DESCRIPTION OF PREFERRED EMBODIMENTS

The present invention comprises a rotatable label system for a pharmaceutical container and associated methods for constructing such a system. The label system generally includes an inner label portion and an outer label portion arranged about the pharmaceutical container, both having written indicia (such as directions for use, dosage amounts, etc.) disposed thereon. Much of this written indicia is custom printed by the pharmacist at the time of pharmaceutical purchase. The outer label portion is rotatable relative to the inner label portion and is provided with a window or transparent section through which indicia located on the inner label portion may be viewed. By rotating the outer label portion, the user may select for viewing a desired subset of the inner label indicia.

Figure 1:
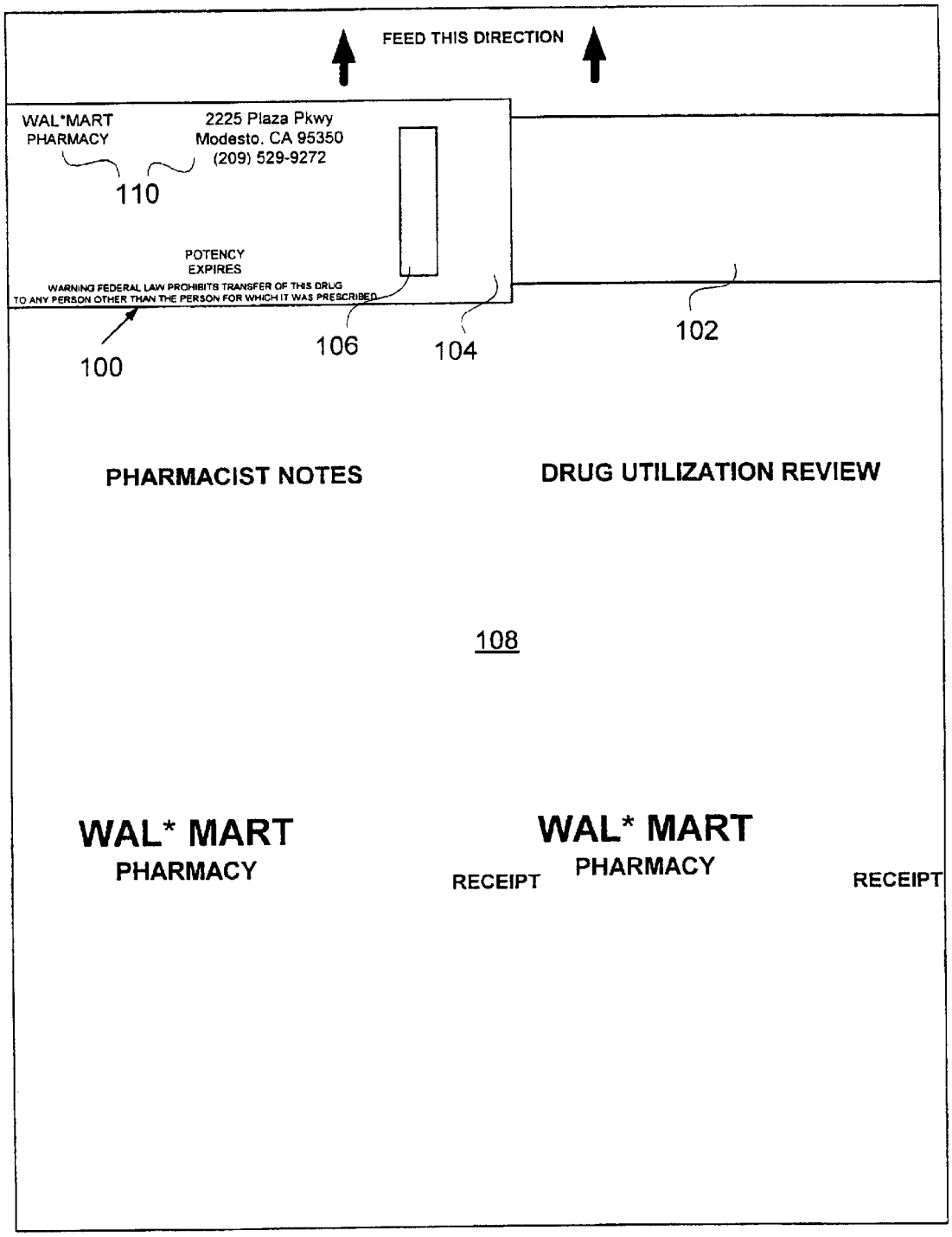
FIG. 1 is a front view of a front surface of a label located on a label sheet, according to the present invention.

FIG. 1 depicts a front surface of a label 100. The label 100 is divided into an inner label portion 102 and an outer label portion 104. The outer label portion 104 is further provided with a window 106, which may comprise either an open area or a transparent material. It is to be appreciated that the open area comprising the window 106 will typically be formed by removing an interior section of the outer label 104 defined by die-cut or perforation lines.

The label 100 may be formed as part of a standard-sized label sheet 108, with die-cut lines or equivalent being provided to define the periphery of the label 100 and permit its separation from a release liner of the label sheet 108. The label sheet 108 may then be inserted into a computer printer to enable printing of appropriate custom indicia onto the front surfaces of the inner label portion 102 and outer label portion 104. Certain indicia 110, such as the name of and contact information for a pharmacy, may be pre-printed onto the inner or outer label portions 102 and 104 prior to the custom indicia imprinting period as shown in FIG. 1. Alternatively, the label 100 may be left completely blank, and be printed with both custom and generic indicia at the time of pharmaceutical purchase.

Figure 2:
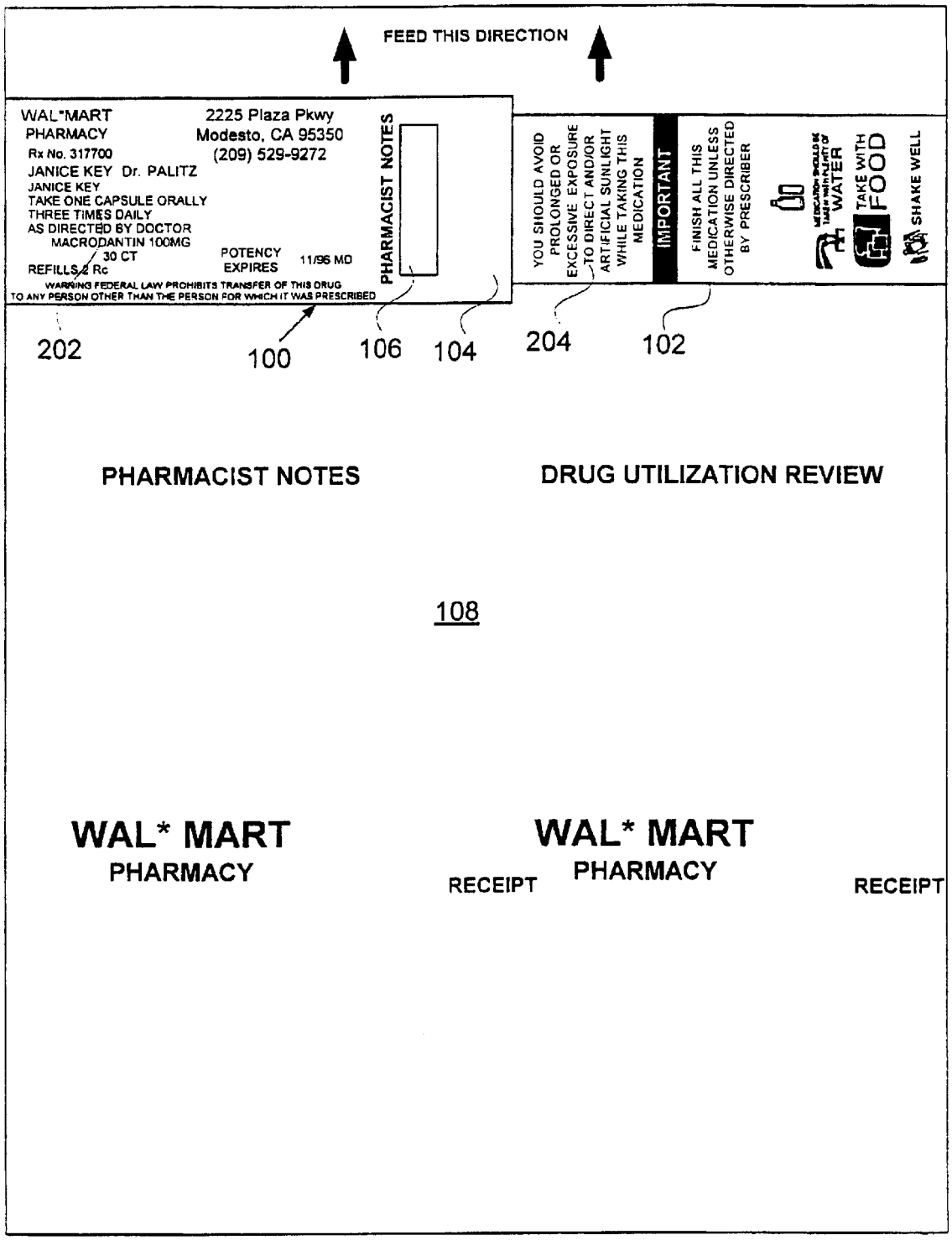
FIG. 2 is a front view of the label of FIG. 1 with additional indicia printed thereon.

FIG. 2 depicts the label 100 and contiguous label sheet 108 after the custom patient indicia has been printed onto the front surfaces of the inner label portion 102 and outer label portion 104. In the example depicted by FIG. 2, a first set of indicia 202 representative of pharmacist notes and instruction is printed on the outer label portion 104, and a second set of indicia 204 representative of drug utilization information is printed on the inner label portion 102. This example is provided by way of illustration only and is not intended to limit the scope of the invention. The indicia to be printed on label 100 may be advantageously generated or selected by using computer software and equipment designed for this purpose.

Figure 3:
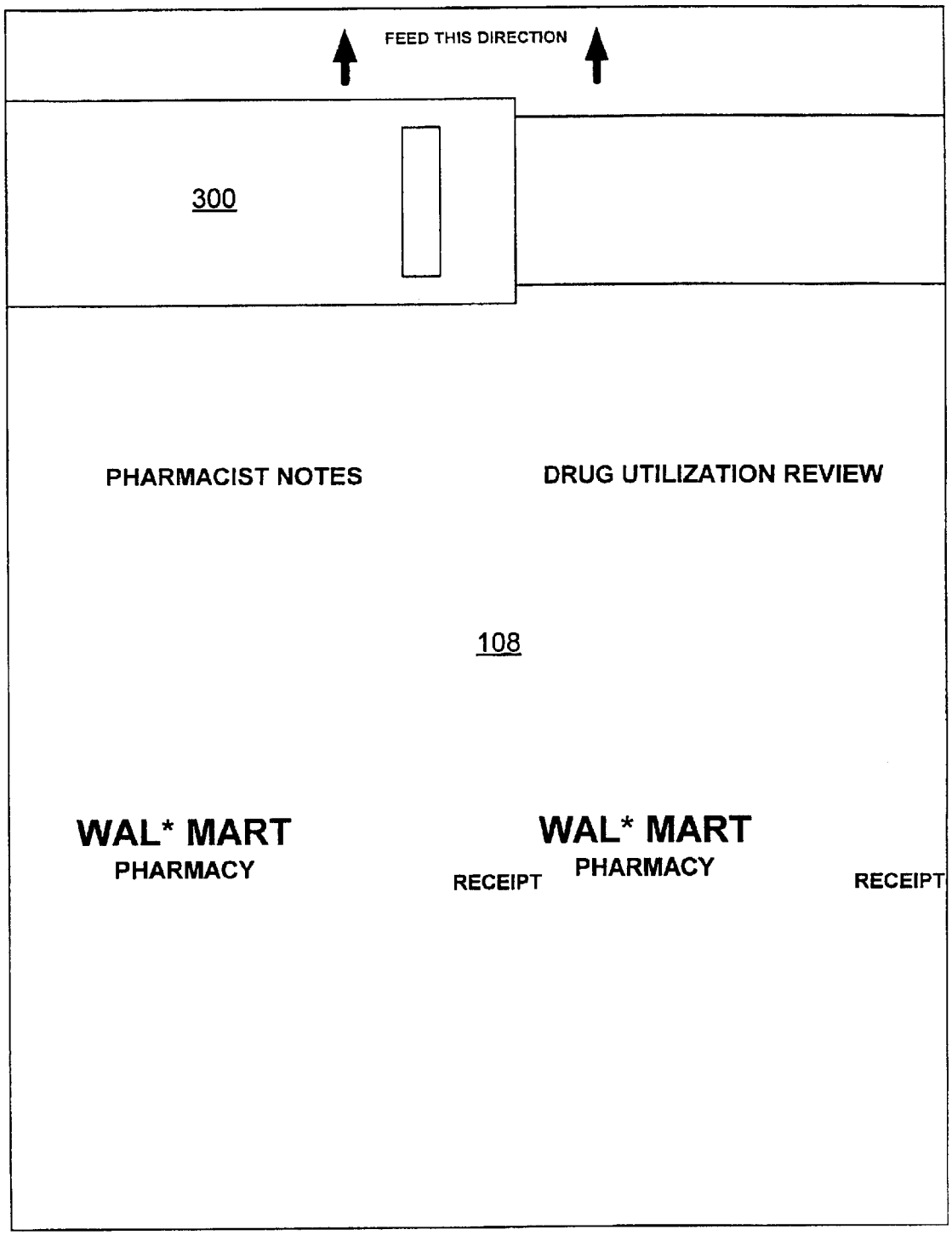
FIG. 3 is a front view of the label sheet of FIG. 1 after the label has been removed.

FIG. 3 depicts the label sheet 108 after label 100 has been removed therefrom. A release liner 300 is disposed adjacent to the rear surface of label 100 to allow the label to be easily separated from the remainder of the label sheet 108.

Figure 4:
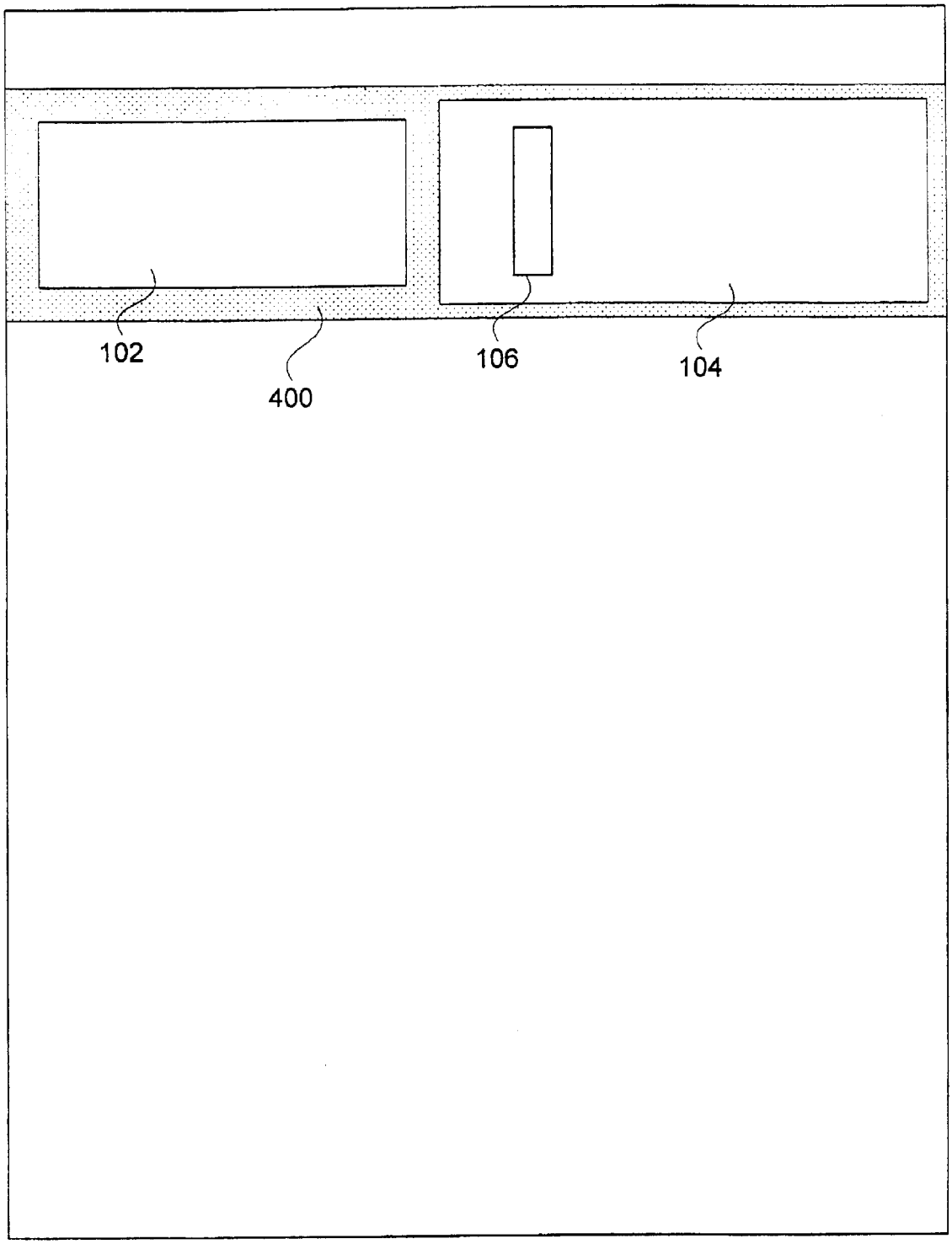
FIG. 4 is a rear view of the label of FIG. 1 depicting an adhesive pattern.

FIG. 4 shows a rear view of the label 100 after removal from the liner 300 (FIG. 3). As shown, a rear surface of the inner label portion 102 and outer label portion 104 have an adhesive material 400 disposed thereon. Although FIG. 4 illustrates a predetermined pattern of adhesive material 400, other variations of patterns may be utilized. The only requirement for the pattern of adhesive material 400 is that the inner label portion 102 must be permanently affixed, while the outer label portion 104 becomes easily rotatable once activated. Thus, the outer label portion 104 should not adhere to the inner label portion 102, nor should the rotating section of the outer label portion 104 adhere to the container.

Figure 5:
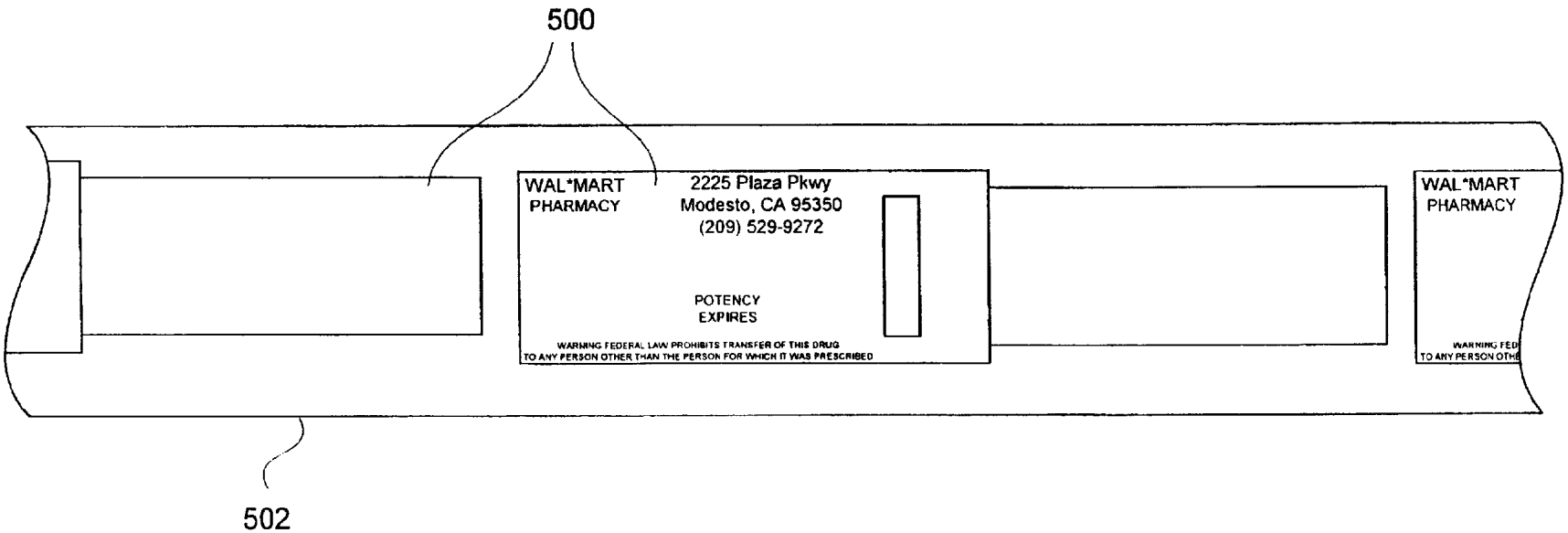
FIG. 5 is a front view of a continuous strip containing multiple labels.

FIG. 5 depicts another embodiment of the invention wherein multiple labels (collectively denoted 500) are arranged on a continuous strip 502. The continuous strip 502 may be formed into a roll or folded in an accordion-style stack. The labels 500 may be fed sequentially into a specialized printer configured to print the desired indicia onto the labels 500. Placing the labels 500 on a continuous strip 502 may facilitate automated printing and application of the labels to pharmaceutical containers. Although not shown, the continuous strip includes a top sheet containing the labels 500 and a release liner removably attached to the top sheet.

Figure 6A:
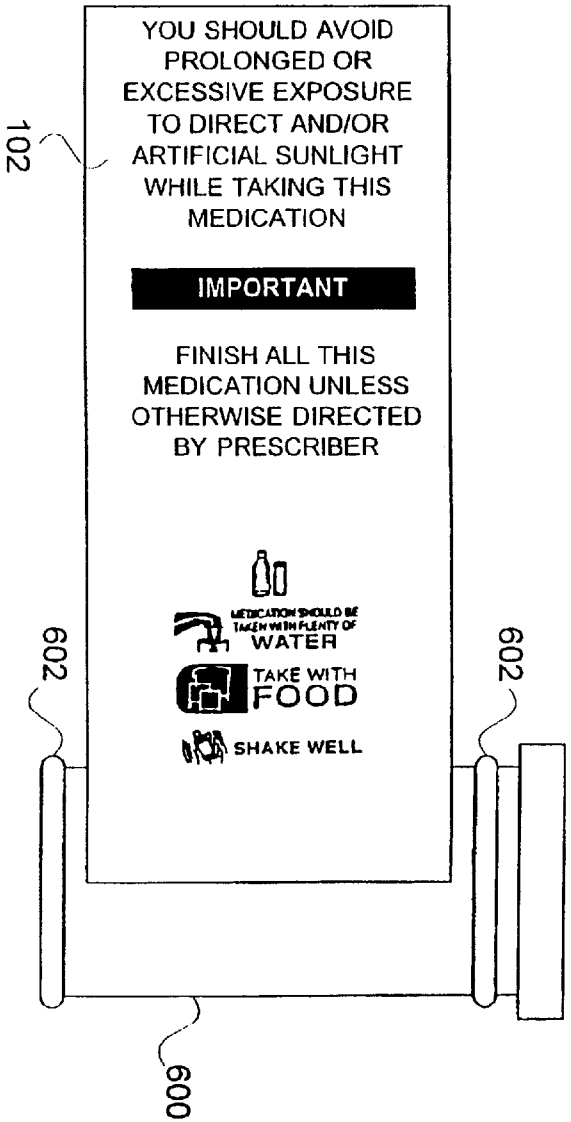
FIG. 6*a* is a side elevation view of a pharmaceutical container with an inner label portion partially affixed to the container.
Figure 6B:
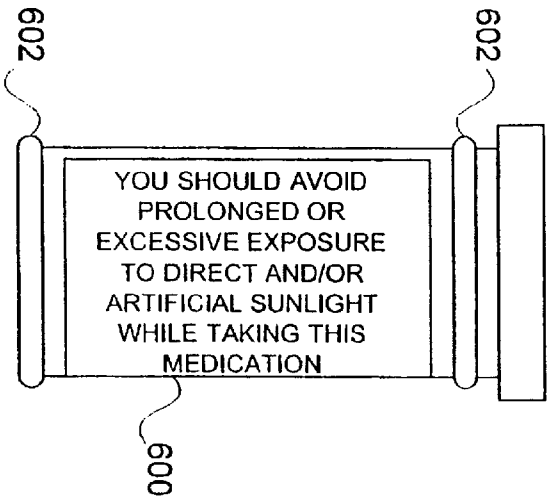
FIG. 6*b* is a side elevation view of the container of FIG. 6*a* with the inner label portion completely affixed to the container.
Figure 6C:
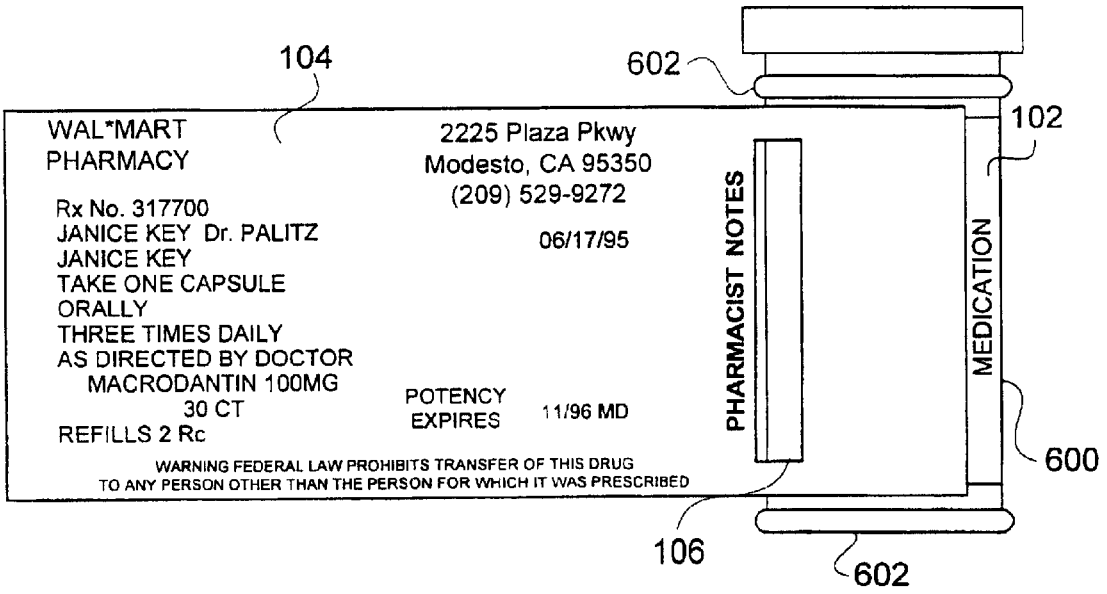
FIG. 6*c* is a side elevation view of the container of FIG. 6*b* with an outer label portion partially disposed about the container.

FIGS. 6*a*–6*c* depict one method for applying the inner and outer portions 102 and 104 of label 100 to a pharmaceutical container 600. This method has two label application steps. In the first step, the inner label 102 is wrapped around the container 600 and affixed thereto by adhesive material located on its rear surface (FIGS. 6*a* and 6*b*). Pharmaceutical container 600 is preferably provided with rims 602. The inner label portion 102 should be affixed to the container 600 between the upper and lower rims 602.

In the second step, the outer label portion 104 is positioned exteriorly of the inner label portion 102 (FIG. 6*c*) and wrapped around the container 600 such that the leading and trailing edges of the outer label 104 overlap and adhere to each other. The outer label portion 104 should be disposed between the upper and lower rims 602 to prevent longitudinal displacement of the outer label portion 104 when rotated about the container 600. Because the adhesive material is disposed only along the leading edge of the outer label portion 104, the outer label portion 104 does not adhere to the underlying inner label portion 102 and may freely rotate relative to the inner label portion 102 and container 600. Those skilled in the art will recognize that different patterns of adhesive material may be utilized to allow the outer label portion 104 to rotate relative to the inner label portion 102.

Figure 6D:
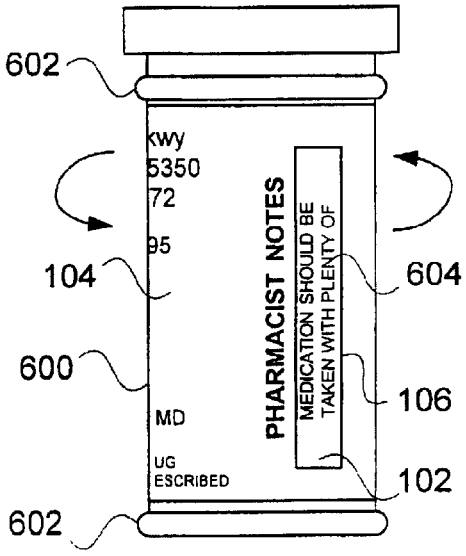
FIG. 6*d* is a side elevation view of the container of FIG. 6*c* with the outer label portion completely disposed about the container.
Figure 6E:
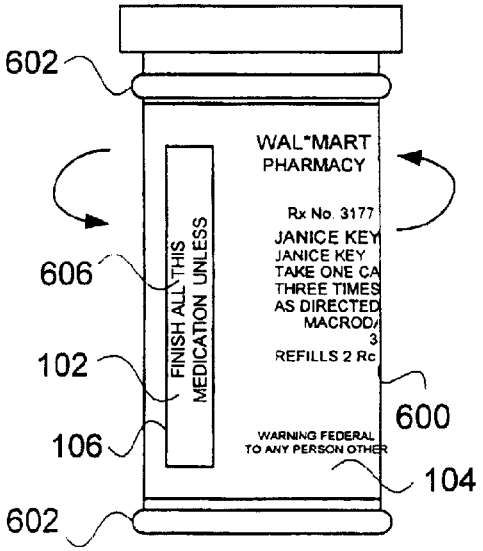
FIG. 6*e* is a side elevation view of the container of FIG. 6*d* with the outer label portion rotated about the container.

As discussed above, rotation of the outer label portion 104 allows the user to view through window 106 a selected subset of the indicia disposed on the inner label portion 102. As shown in FIG. 6*d*, window 106 is positioned such that one set of instructions 604 is viewable through the window 106. After rotation of the outer label portion 104 a second set of instructions 606 can be seen through the window 106 in FIG. 6*e*.

Figure 7A:
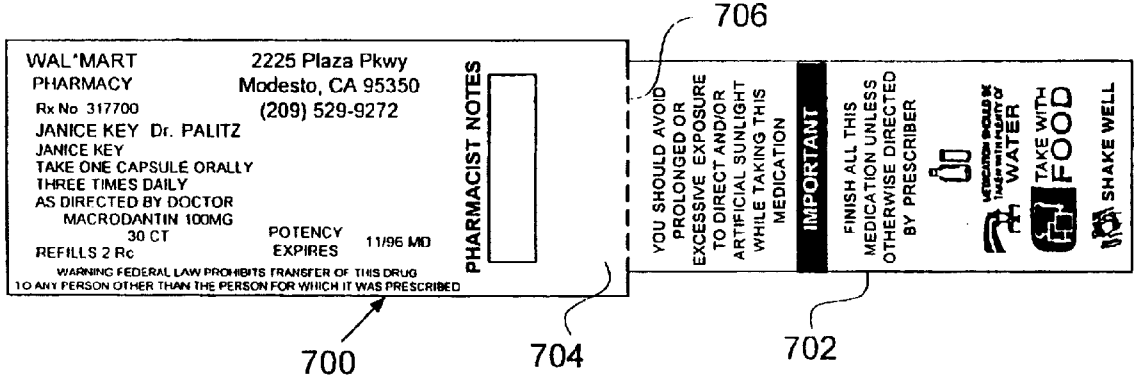
FIG. 7*a* is a front view of an alternative embodiment of a label.

FIG. 7*a* depicts an alternative embodiment of a label 700 wherein inner label portion 702 is coupled to outer label portion 704 along a perforation line 706. This embodiment enables the label 700 to be applied to a pharmaceutical container 708 in a single step.

Figure 7B:
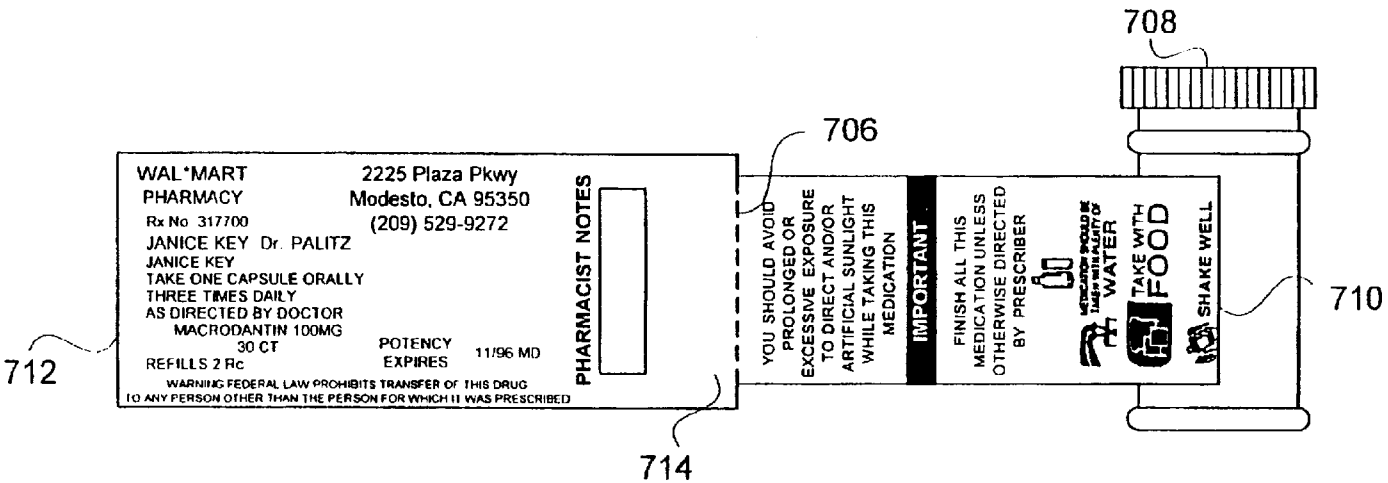
FIG. 7*b* is a side elevation view of a pharmaceutical container with the label of FIG. 7*a* partially affixed to the container.

Specifically, application of the label 700 to pharmaceutical container 708 is accomplished by engaging a leading edge 710 of liner label portion 702 with the container 708 as shown in FIG. 7*b*. The label 700 is then wrapped about the exterior of the container 708 until a trailing edge 712 of outer label portion 704 overlaps with and adheres to a leading edge 714 of the outer label portion 704. The placement of adhesive material on selective areas of the rear surfaces of the inner and outer label portions 702 and 704 causes the inner label 702 to be affixed to the container 708, while the outer label 704 adheres only to itself (along the leading and trailing edges 714 and 712 thereof). The user may then uncouple the outer label portion 704 from the inner label portion 702 by applying a rotational force to the outer label portion 704 while holding the container 708 stationary. This rotational force causes the label 700 to tear along the line of weakening formed by perforation line 706. Thereafter, the outer label portion 704 is free to rotate relative to inner label portion 702 and container 708. It is noted that while a single vertical perforation line is shown in the figures, multiple perforation lines or alternative geometries of perforation lines may be utilized to detachably couple the inner and outer labels portions 702 and 704.

Figure 8A:
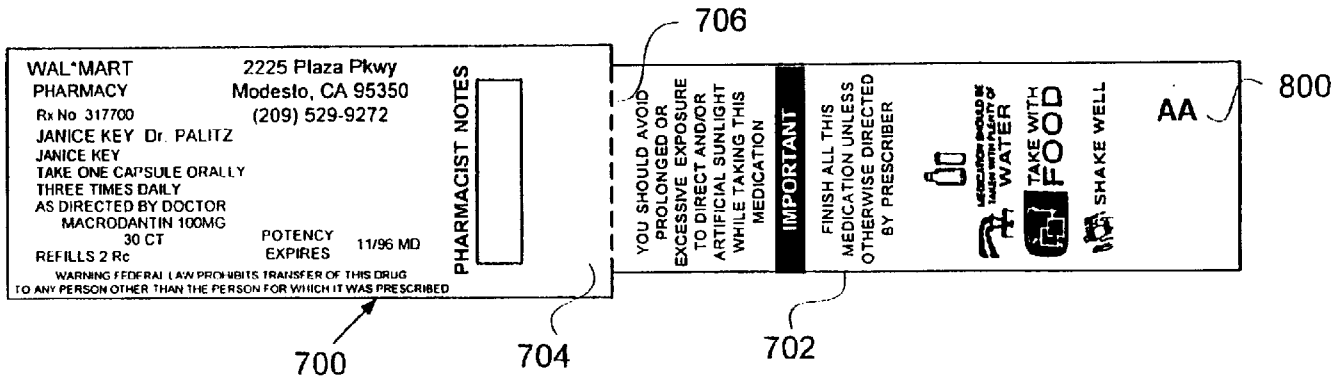
FIG. 8*a* is a front view of a label for use with various sized containers.

FIG. 8*a* shows the label 700 of the foregoing description designed in such a manner as to permit use with differing sized containers. The inner label portion 702 is shown with an area 800 designated AA. The area 800 may be left blank for used with smaller containers or printed on for larger containers.

Figure 8B:
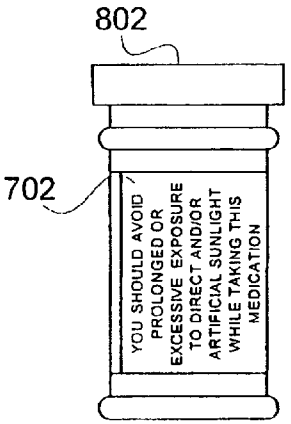
FIG. 8*b* is a side elevation view of a small pharmaceutical container with an inner label portion of the label of FIG. 8*a* disposed thereon.

FIG. 8*b* illustrates the use of label 700 with a small container 802. When applied to the relatively small container 802, the leading and trailing edges of the inner label portion 702 are in overlapping relation, thus obscuring the area 800 of inner label portion 702. For this reason, the area 800 is left blank when the label 700 is to be applied to a smaller container 802.

Figure 8C:
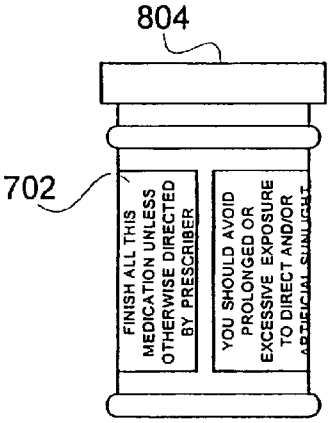
FIG. 8*c* is a side elevation view of a large pharmaceutical container with an inner label portion of the label of FIG. 8*a* disposed thereon.

If the label is applied to a relatively larger container 804 (FIG. 8*c*), the leading and trailing edges of the inner label portion 702 may not be in an overlapping relation when wrapped around the larger container 804. Thus, the area 800 is not obscured and may therefore be used to present additional information to the consumer.

Figure 9A:
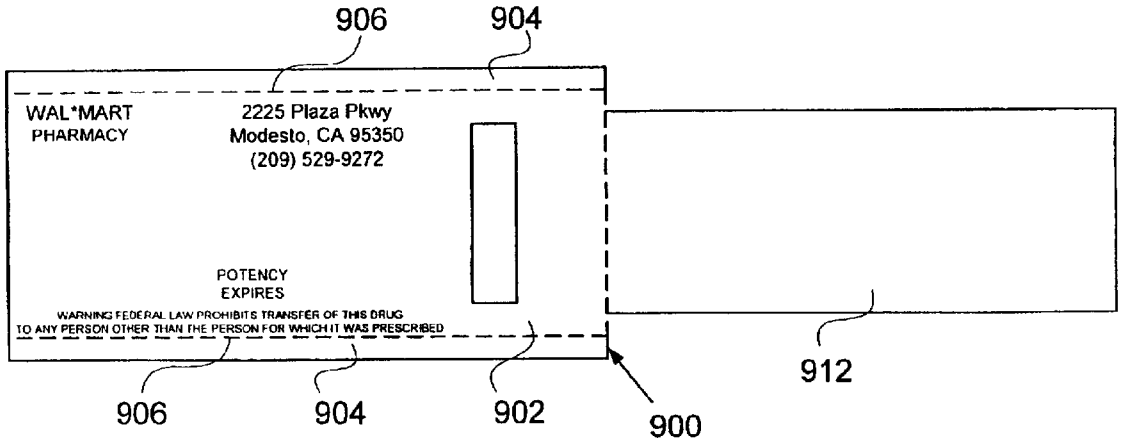
FIG. 9*a* is a front view of an alternative embodiment of a label, according to the present invention.

FIG. 9*a* depicts another embodiment of a label 900 wherein the outer label portion 902 is adapted with upper and lower rails 904. The rails 904 are each coupled to the outer label portion 902 by horizontal perforation lines 906. The label 900 may be constructed on a single sheet such as the label 100 of FIG. 1 or on a continuous strip as shown in FIG. 5.

Figure 9B:
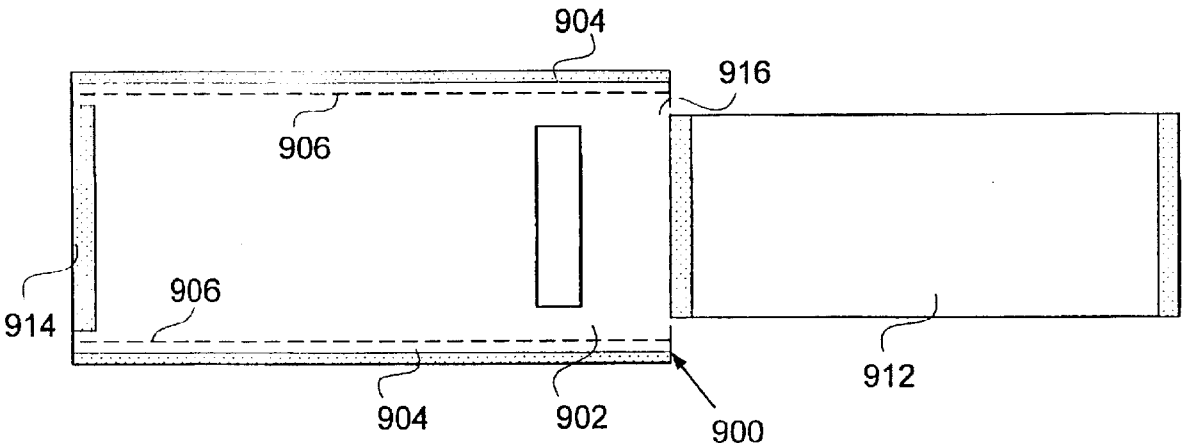
FIG. 9*b* is a rear view of the label of FIG. 9*a;*

FIG. 9*b* shows the rear side of the label 900. The rails 904 carry on their rear surface adhesive material 908 that causes the rails to be affixed to the container 910. Adhesive material 908 is also applied to areas of the inner label portion 912 to secure the inner label portion 912 to the container. Furthermore, adhesive material 908 is applied to the trailing edge 914 of the outer label portion 902 to adhere the trailing edge 914 to its own leading edge 916.

Figure 9C:
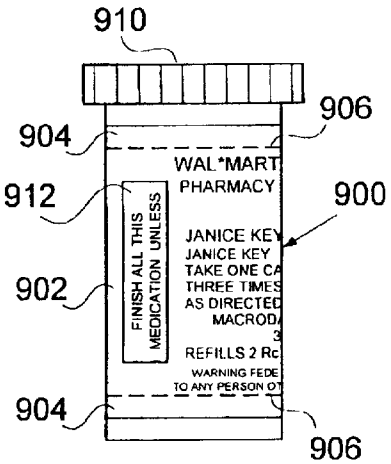
FIG. 9*c* is a side elevation view of a pharmaceutical container having the label of FIG. 9*a* disposed thereon.

FIG. 9*c* depicts the label 900 after the label 900 is properly disposed about a container 910. Because the rails 904 are affixed to the container 910, the application of a rotational force to outer label portion 902 will cause the rotatable section of the outer label portion 902 to become detached from the rails 904 along the perforation lines 906. This detachment allows the rotatable section of the outer label portion 902 to be rotated relative to the inner label portion 902 and container 910. The presence of the rails 904 serves to prevent longitudinal displacement of the outer label portion 902 with respect to the container 910.

Figure 10:
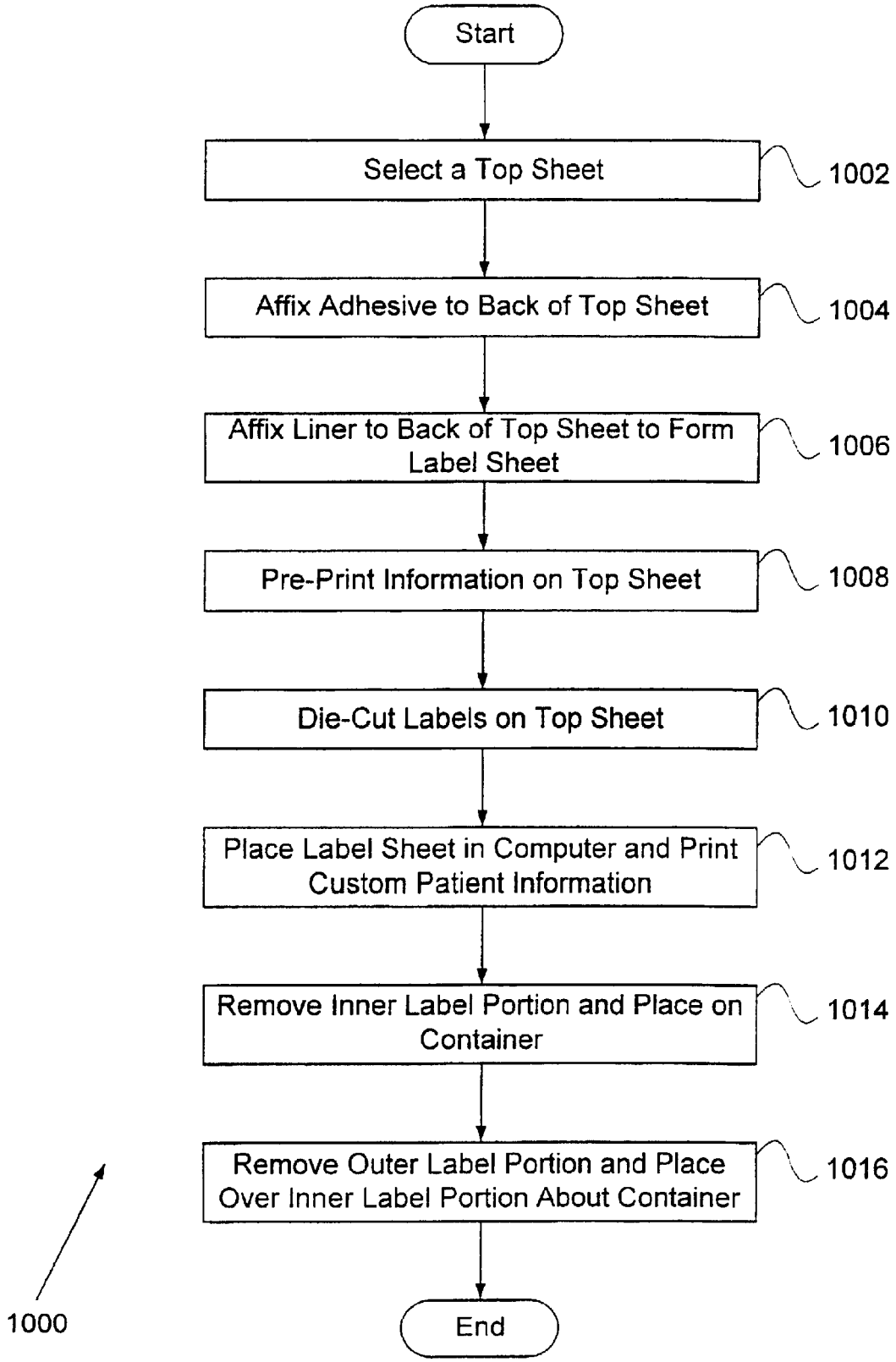
FIG. 10 is a flowchart of a method for affixing a rotatable label to a pharmaceutical container, according to the present invention.

FIG. 10 is a flowchart 1000 that illustrates one method for generating and applying a label to a pharmaceutical container in accordance with the present invention. Initially in block 1002, the label manufacturer selects a top sheet. A portion of this top sheet will form the label of the present invention. The top sheet may be utilized as part of a standard-sized label sheet or a continuous label strip as described above.

In block 1004, adhesive material is affixed to the back of the top sheet. As previously discussed, the adhesive material may be disposed in various patterns such that an inner label portion will remain affixed to a container and the outer label portion becomes rotatable about the inner label portion.

In block 1006, a release liner is affixed to the back of top sheet, thus forming a label sheet. This release liner will prevent the top sheet from inadvertently affixing to other objects prior to its intended use on a pharmaceutical container.

General information is then printed onto the top sheet in block 1008. This general information may include generic warnings, pharmacist information, and logos. In an alternative embodiment, the label may be left completely blank. Next, the top sheet is die-cut into labels in block 1010. Although the flowchart 1000 shows the printing of general information prior to the die-cutting, those skilled in the art will recognize that the steps may be practiced in differing order. For example, the inner and outer label portions may be die-cut onto the top sheet prior to the application of adhesive to the rear surface of the inner and outer label portions and the subsequent attachment of the release liner.

The pharmacist then performs the following steps at the time of medication purchase. In block 1012, a pharmacist will place the label sheet in a printer to print custom patient information thereon. This information may include the drug name, instructions for use, and refill amounts. As discussed above, the label can be located on a single label sheet or on a roll of labels.

The pharmacist then removes the inner label portion from the release liner and affixes it to a pharmaceutical container containing the prescribed drug in block 1014.

Finally, the outer label portion is removed from the release liner and placed over the inner label portion in block 1016. Because only a select area of the outer label portion has an adhesive material disposed thereon, the outer label portion only adheres to itself, thus resulting in a rotatable outer label.

Figure 11:
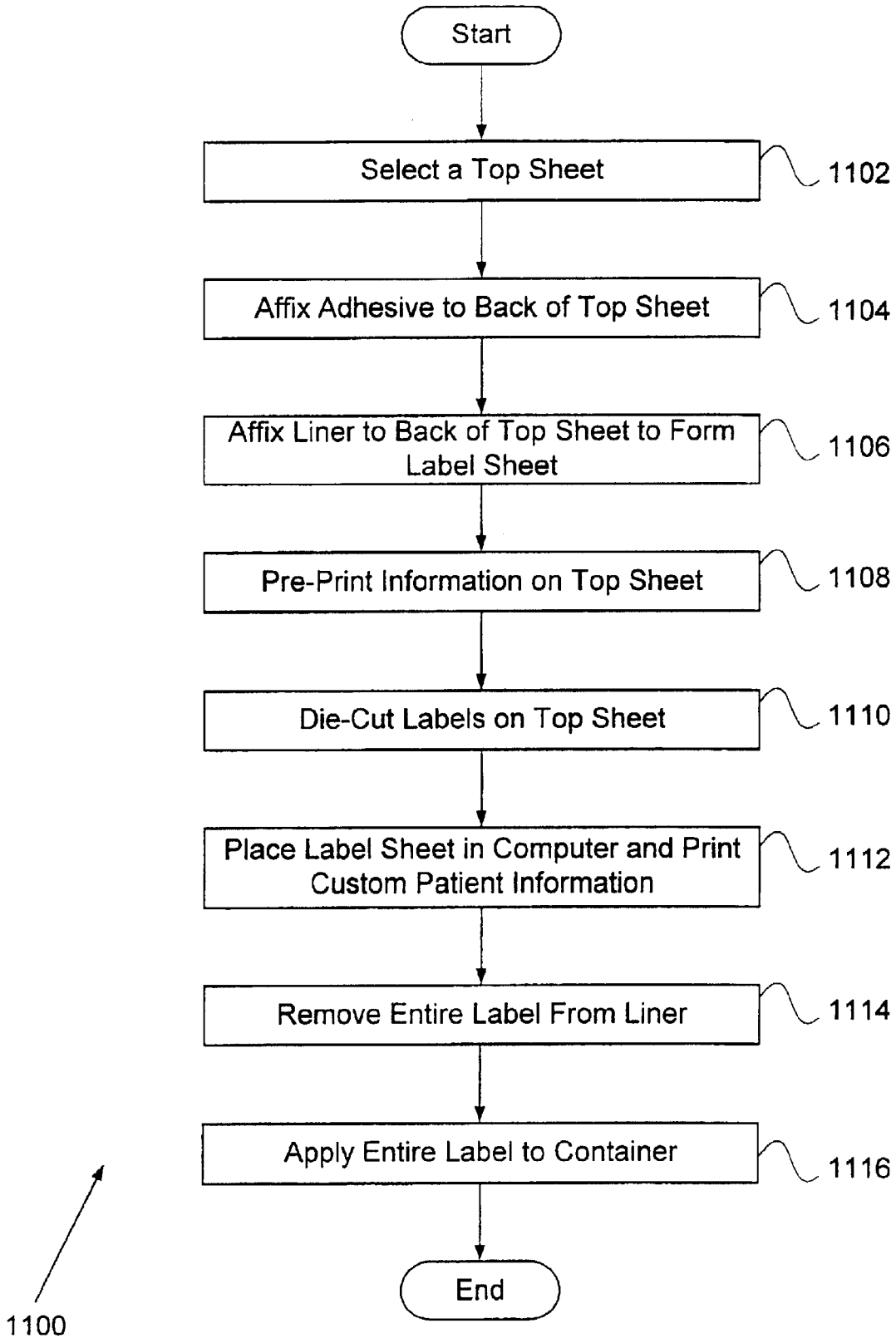
FIG. 11 is a flowchart of an alternative method for affixing a rotatable label to a pharmaceutical container, according to the present invention.

FIG. 11 is a flowchart 1100 that illustrates an alternative method for generating and applying the label as described in connection with FIGS. 7*a*–7*b* and FIGS. 9*a*–9*c* to a pharmaceutical container. Blocks 1102 through 1112 are identical to the steps of blocks 1002 through 1012 of FIG. 10. In block 1114, the entire label is removed from the release liner and disposed about a pharmaceutical container. Because the entire label contains both the inner and outer label portions, the method of applying this label is completed in one step.

Figure 12B:
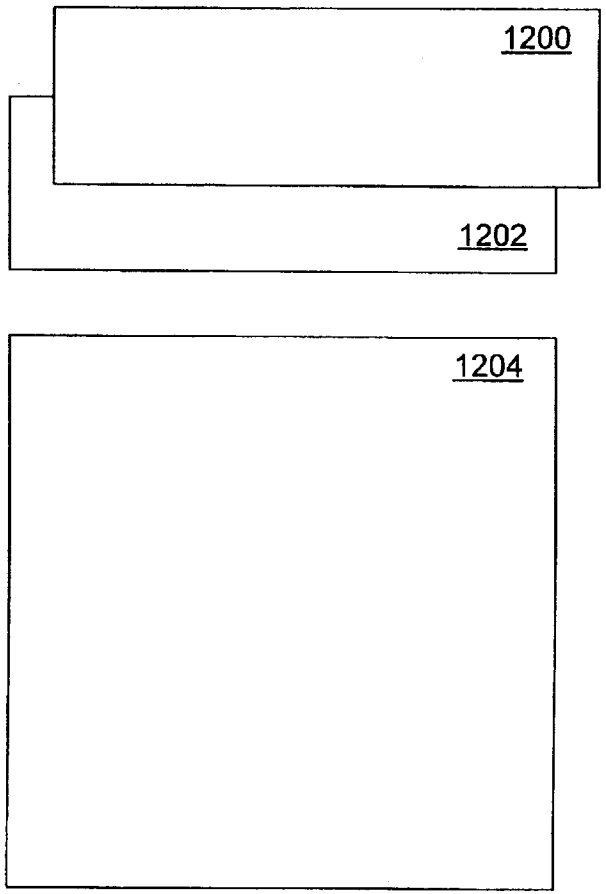
FIG. 12*b* is a front view of the embodiment of FIG. 12*a* with the top sheet overlapping the liner.
Figure 12A:
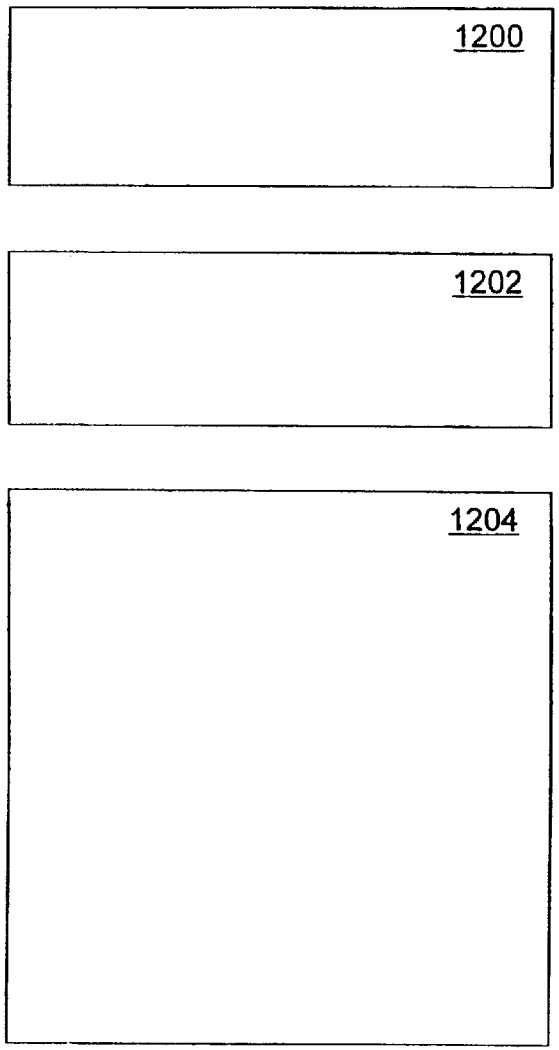
FIG. 12*a* is a front view of an alternative embodiment having a top sheet, a liner, and paper.
Figure 12D:
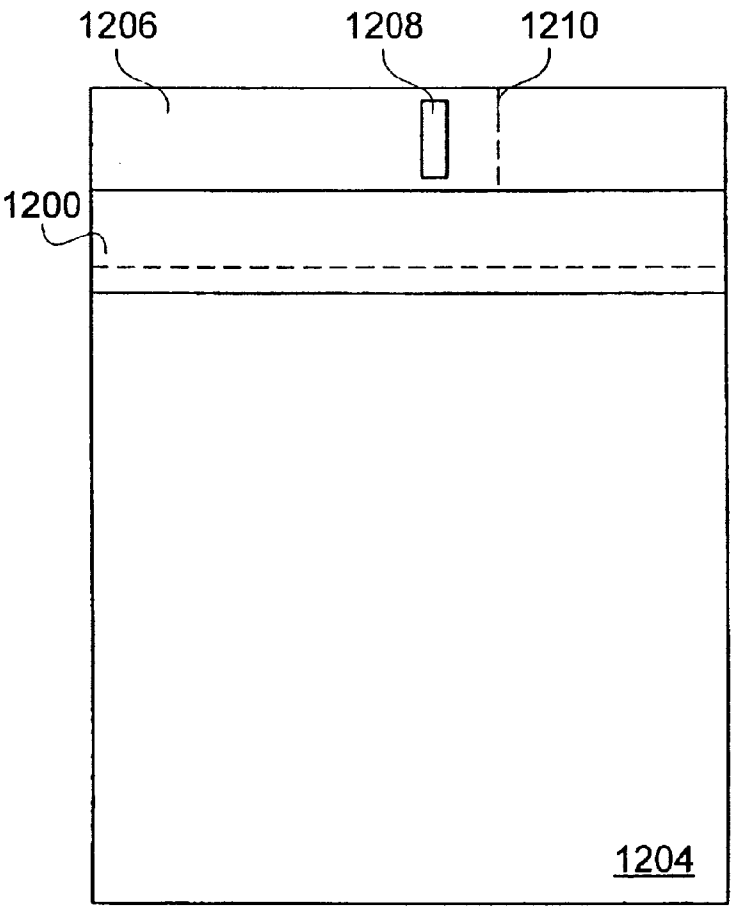
FIG. 12*d* is a front view of the embodiment of FIG. 12*a* with the top sheet and liner arranged on the paper.

FIGS. 12*a*–12*d* illustrate vet another embodiment and method for constructing a rotatable label for a pharmaceutical container. FIG. 12*a* shows the three separate elements which combine to form a label sheet—top sheet 1200, liner 1202, and paper 1204. The top sheet will form the actual label of the present invention, and may be constructed from various materials such as paper or film.

In FIG. 12*b*, the top sheet 1200 overlaps the liner 1202. The top sheet 1200 will have a pattern of adhesive material disposed on its rear surface. Thus, when the top sheet 1200 is placed over the liner as shown in FIG. 12*c*, the top sheet 1200 is selectively, removably affixed to the liner 1202.

Figure 12C:
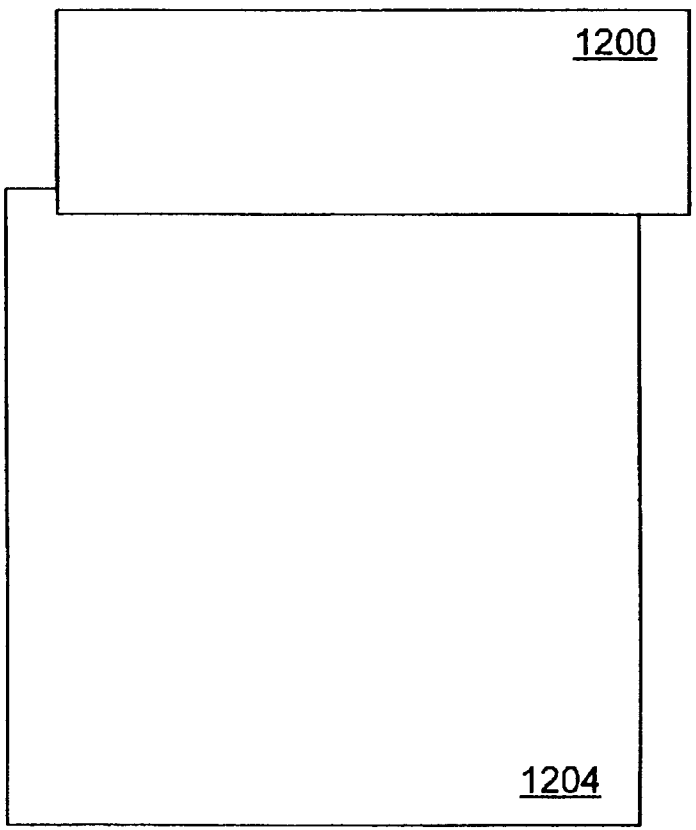
FIG. 12*c* is a front view of the embodiment of FIG. 12*a* with the top sheet removably affixed to the liner.

The combination of the top sheet 1200 and the liner 1202 is then positioned over the paper 1204 such that a lower portion of the top sheet 1200 and the liner 1202 overlap a top portion of the paper 1204 as shown in FIG. 12*c* to form a label sheet. The label sheet may be sized for use in a standard printer. Conventionally, the label sheet may be 8.5 inches wide by 11 inches high.

Once the label sheet is constructed, the top sheet 1200 is die-cut to form a label 1206. A window 1208 and a perforation line 1210 separating an inner label portion from an outer label portion is also die-cut into the top sheet 1200. Additionally, if the label of FIGS. 9*a*–9*c* is desired, the rails 904 may also be die-cut into the top sheet 1200.

Although FIGS. 12*a*–12*d* show die-cutting of the label after the top sheet 1200 and the liner 1202 have been attached to the paper 1204, the label may be die-cut at any time. For example, the die-cut process may occur immediately after the top sheet 1200 is selectively, removably attached to the liner 1202 or prior to attachment to the liner 1202.

The invention has been described above with reference to specific embodiments. It will be apparent to those skilled in the art that various modifications may be made and other embodiments can be used without departing from the broader scope of the invention. Therefore, these and other variations upon the specific embodiments are intended to be covered by the present invention, which is limited only by the appended claims.

What is claimed is:

1. A method for labeling pharmaceutical containers, comprising the steps of:

providing a label having an inner label portion and an outer label portion, the outer label portion having a window;

printing custom patient information onto at least one of the inner label portion or the outer label portion;

affixing the inner label portion to the outer surface of the container; and disposing the outer label portion about the inner label portion such that indicia on the inner label portion may be viewed through the window, the outer label portion being rotatable about the inner label portion and the container.

2. The method of claim 1 wherein the step of printing further comprises the step of placing a label sheet containing the inner and outer label portion into a printer.

3. The method of claim 1 wherein the step of printing further comprises the step of placing one inner and outer label portion of a roll of labels into a printer.

4. The method of claim 1 wherein the step of affixing further comprises the step of removing the inner label portion from a release liner.

5. The method of claim 1 wherein the step of affixing further comprises the step of affixing the inner label portion between surface contours located circumferentially about a top and bottom portion of the container.

6. The method of claim 1 wherein the step of disposing further comprises the step of removing the outer label portion from a release liner.

7. The method of claim 1 wherein the step of disposing further comprises the step of disposing the outer label portion between surface contours located circumferentially about a top and bottom portion of the container.

8. The method of claim 1 wherein the steps of affixing and disposing are performed in one continuous application.

9. A rotatable label system for a pharmaceutical container, comprising:

a pharmaceutical container;

a label having an inner label portion and an outer label portion, the outer label portion having a window; and a printer for printing custom patient information onto at least one of the inner label portion of the outer label portion prior to application to the container.

10. The rotatable label system of claim 9 wherein the window comprises a transparent section which permits viewing of an underlying subset of indicia located on the inner label portion.

11. The rotatable label system of claim 9 wherein the window comprises a removed section of the outer label portion which permits viewing of an underlying subset of indicia located on the inner label portion.

12. The rotatable label system of claim 9 wherein the pharmaceutical container is adapted with a top and bottom surface contour extending circumferentially around the container, the outer label portion being positioned between the top and bottom surface contour for prohibiting the longitudinal displacement of the outer label portion.

13. The rotatable label system of claim 9 wherein the inner and outer label portions are connected along a perforation line, the outer label portion detaching along the perforation line to rotate about the inner label portion and the container.

14. The rotatable label system of claim 9 wherein the outer label portion is adapted with upper and lower rails coupled to the outer label portion by horizontal perforation lines.

15. The rotatable label system of claim 14 wherein the upper and lower rails have adhesive material disposed on rear surfaces.

16. The rotatable label system of claim 9 wherein an adhesive material is disposed on a trailing edge of a rear surface of the outer label portion, the trailing edge of the outer label portion only adhering to a leading edge of the outer label portion.

17. The rotatable label system of claim 9 wherein the inner and outer label portions are formed on a top sheet, the inner and outer label portions being die-cut on the top sheet.

18. The rotatable label system of claim 17 wherein the top sheet is selectively, removably attached to a release liner to form a label sheet, the label sheet sized for printing on the printer.

19. The rotatable label system of claim 18 wherein the label sheet is a continuous sheet containing multiple inner and outer label portions.

20. The rotatable label system of claim 17 wherein the top sheet is selectively, removably attached to a release liner, the release liner being further attached to a paper to form a label sheet, wherein the label sheet is sized for printing on the printer.

* * * * *